US010873158B2

(12) United States Patent
Lückemeier et al.

(10) Patent No.: US 10,873,158 B2
(45) Date of Patent: Dec. 22, 2020

(54) PLUG CONNECTOR WITH SECURING ELEMENT

(71) Applicant: HARTING Electronics GmbH, Espelkamp (DE)

(72) Inventors: Martin Lückemeier, Rahden (DE); Andreas Doehring, Espelkamp (DE)

(73) Assignee: Harting Electronics GmbH, Espelkamp (DE)

( * ) Notice: Subject to any disclaimer, the term of this patent is extended or adjusted under 35 U.S.C. 154(b) by 314 days.

(21) Appl. No.: 15/776,381

(22) PCT Filed: Nov. 9, 2016

(86) PCT No.: PCT/DE2016/100529

§ 371 (c)(1),
(2) Date: May 15, 2018

(87) PCT Pub. No.: WO2017/084654

PCT Pub. Date: May 26, 2017

(65) Prior Publication Data

US 2020/0259295 A1 Aug. 13, 2020

(30) Foreign Application Priority Data

Nov. 19, 2015 (DE) ..... 10 2015 120 025

(51) Int. Cl.
*H01R 13/639* (2006.01)
*H01R 13/627* (2006.01)

(52) U.S. Cl.
CPC ..... *H01R 13/639* (2013.01); *H01R 13/6277* (2013.01)

(58) Field of Classification Search
CPC ..... H01R 13/639; H01R 13/6277; H01R 13/6275

(Continued)

(56) References Cited

U.S. PATENT DOCUMENTS 4,229,064 A 10/1980 Vetter et al.
4,782,971 A 11/1988 Hill (Continued)

FOREIGN PATENT DOCUMENTS

CN 101141034 A 3/2008
CN 201312021 Y 9/2009

(Continued)

OTHER PUBLICATIONS

Machine Translation of WO2007071479 A1 (Jun. 28, 2007), [database online], [retrieved on Jun. 10, 2020]. Retrieved from Espacenet (Year: 2007).*

(Continued)

*Primary Examiner* — Travis S Chambers

(74) *Attorney, Agent, or Firm* — Seed IP Law Group LLP; Jared M. Barrett

(57) ABSTRACT

A plug connector is provided which has a base body and a slide element, wherein the base body has a plug side and a connection side, wherein the plug connector forms a plug axis which extends from the plug side to the connection side through plug the connector, wherein the slide element surrounds the base body and is arranged on the same to be movable along the plug axis. The connector additionally has a securing element, wherein the securing element is arranged between the slide element and the connection side of the plug connector, and wherein the securing element is arranged on the base body to be movable between an open position and a locked position.

10 Claims, 3 Drawing Sheets

(58) Field of Classification Search
USPC ..... 439/345, 347, 349, 352, 372
See application file for complete search history.

(56) References Cited

U.S. PATENT DOCUMENTS

| | | | | |
|---|---|---|---|---|
| 7,408,122 | B2 * | 8/2008 | Heimlicher | H02G 3/0658 16/2.1 |
| 7,507,105 | B1 * | 3/2009 | Peters | H01R 13/53 439/374 |
| 7,972,158 | B2 * | 7/2011 | Wild | H01R 13/6277 439/257 |
| 9,263,867 | B2 * | 2/2016 | Strelow | H02G 3/0658 |
| 2008/0064250 | A1 | 3/2008 | Lee et al. | |
| 2009/0029584 | A1 | 1/2009 | Sami | |
| 2009/0264003 | A1 | 10/2009 | Hertzler et al. | |

FOREIGN PATENT DOCUMENTS

| | | | |
|---|---|---|---|
| DE | 10 200 5060657 | A1 | 6/2007 |
| WO | 2007/071479 | A1 | 6/2007 |
| WO | 2015/063048 | A1 | 5/2015 |

OTHER PUBLICATIONS

European Office Action dated Feb. 13, 2020, for European Application No. 16 801 947.9, 7 pages.

Harting Elektronik GmbH, "Schwere Steckverbinder Han-Modular®," Product Catalog, Jan. 1999, 44 pages.

International Preliminary Report on Patentability, dated May 22, 2018, for International Application No. PCT/DE2016/100529, 14 pages. (with English Translation).

Written Opinion of the International Searching Authority, dated Feb. 17, 2017, for International Application No. PCT/DE2016/100529, 6 pages. (English Translation).

Chinese Office Action dated Mar. 21, 2019, for Chinese Application No. 201680066549.8, 8 pages.

German Office Action dated Mar. 27, 2019, for German Application No. 10 2015 120 025.2, 12 pages. (with English Machine Translation).

International Search Report and Written Opinion, dated Feb. 17, 2017, for International Application No. PCT/DE2016/100529, 11 pages. (with English Translation of Search Report).

* cited by examiner

PLUG CONNECTOR WITH SECURING ELEMENT

TECHNICAL FIELD

This disclosure relates to a plug connector having a base body, a sliding element and a securing element.

BACKGROUND

Description of the Related Art

Plug connectors are required in order to reversibly connect lines to one another. Plug connectors are fastened to ends of lines and provide individual conductors in the line with contact elements that are received in the plug connector. The contact elements may contact corresponding contact elements in the mating plug connector when the plug connector is being connected to a further mating plug connector.

In order to ensure a reliable connection to a mating plug connector, plug connectors usually comprise latching means that render it possible to latch the plug connectors to one another. Various mechanisms are known from the prior art in order to release the latching arrangement. The so-called push-pull locking mechanism is a frequently used mechanism. The plug connector automatically latches to the mating connector during the connecting procedure. The plug connector latches by means of being pushed. The locking mechanism is released by means of pulling on a sliding element that forms at least in part the housing of the plug connector. When the sliding element is displaced in the opposite direction to the plugging direction, the mechanism is actuated so as to latch to the plug connector and the plug connector is released from the mating plug connector.

Various push-pull plug connectors are known from the prior art and said connectors all latch and unlatch according to a similar principle. The plug connector and mating plug connector are latched to one another by means of plugging the plug connector onto a mating plug connector. The latching arrangement is released by means of pulling on a sliding element and the plug connector may be removed.

A disadvantageous effect of the known solutions is that the simplicity of the construction may likewise have a negative effect. It is possible to release the plug connector from the mating connector and to interrupt the contacting arrangement between the plug connector and the mating connector by means of merely pulling the plug connector. Depending upon the application, this may not be desirable and may have a negative effect. It is thus possible for example in the case of a plurality of push-pull plug connectors that are arranged in a particularly tight space for an adjacent plug connector to be accidentally released from the mating connector and for the contacting arrangement to be interrupted when removing a plug connector.

BRIEF SUMMARY

Embodiments of the present invention provide a push-pull plug connector that may be secured against being accidentally unlocked and for the contacting arrangement to be secured against being interrupted. The plug connector is thus to be provided in such a manner that it is necessary to actuate at least one further hand grip in order to release the plug connector from the mating connector. However, in order to make it simple to handle the plug connector, it is furthermore to be possible to operate said plug connector with one hand.

Embodiments of the invention relate to improvements or enhancements to a so-called push-pull plug connector that is known from the prior art. According to embodiments of the invention, a plug connector comprises a base body and contact elements and a cable that is to be connected are received in said base body. The base body is surrounded by a sliding element that functions as an actuator of the plug connector and simultaneously is used to unlock a latching arrangement to a mating plug connector.

The plug connector forms a plugging side and a connecting side. The connecting side renders it possible to insert a line into the base body of the plug connector. The strands of the line are connected to contact elements in the plug connector. The contact elements are in turn guided to the plugging side of the plug connector and render it possible to contact a mating plug connector. A plugging axis extends centrally through the plug connector from the plugging side to the connecting side.

In order to realize a secure latching arrangement to a mating plug connector, the plug connector comprises latching devices or means that cooperate with the mating plug connector and prevent an undesired interruption of the contacting arrangement. The sliding element is provided on the plug connector in order to disconnect the plug connector and the mating plug connector. The sliding element is attached to the base body in such a manner that said sliding element may be displaced around a defined region on the base body. The sliding element acts upon the latching devices or means of the plug connector by being displaced in the opposite direction to the plugging direction away from the plugging side towards the connecting side. The latching arrangement between the plug connector and mating connector is thus released.

In accordance with embodiments of the invention, the plug connector comprises an additional securing element that is likewise attached to the base body of the plug connector. The securing element is arranged in such a manner that it may move between two positions: an open position and a locked position. The securing element blocks the movement of the sliding element from a plugging-side end position into a connecting-side end position if said securing element is in the locked position. In the open position, the securing element releases the sliding element to enable it to move and renders it possible to interrupt the contacting arrangement and to release the plug connector from the mating plug connector.

In a particularly advantageous embodiment, the securing element is arranged in a rotatable manner on the plug connector. As a consequence, the securing element may be rotated from the open position into the locked position and conversely. This makes the securing element particularly simple to handle and means that a user does not need to use a second hand. In an expedient manner, the securing element is configured in an annular manner and surrounds the plug connector in such a manner that said securing element is able to rotate about the plugging axis.

In order to block a movement of the sliding element, in a preferred embodiment the securing element comprises at least one blocking region. In the locked position of the securing element the blocking region is located in the movement region of the sliding element. It is thus possible to prevent the sliding element from becoming displaced and thus releasing the locking arrangement. The blocking region is configured in such a manner that it extends radially away from the securing element and the plugging axis. Depending upon the position of the securing element (open or locked position), the blocking region is located in the movement path of the sliding element or releases said sliding element to enable it to move.

In particularly advantageous embodiments, the securing element comprises two or four blocking regions. The blocking regions are arranged uniformly about the periphery of the securing element. It is particularly advantageous that there are four blocking regions that are able to move in the opened state in four corners of a square plug connector and its sliding element. It is thus possible for the rectangular sliding element to be displaced in such a manner that the four blocking regions are received in and slide into the corner regions of said sliding element.

A specific embodiment provides that the securing element is to be arranged on the base body of the plug connector between the sliding element and a cable gland on the connecting side of the plug connector. This arrangement is particularly advantageous since the securing element is thus located in the movement path of the sliding element so as to unlatch the plug connector. Embodiments of the present invention provide a plug connector in a particularly advantageous manner and the problems that are known from the prior art are rectified by means of the embodiments of the plug connector in accordance with the invention having a rotatable securing element. It is possible in a simple manner to prevent the plug connection being accidentally released from the mating connector and the contacting arrangement being interrupted and it is furthermore simple to handle the plug connector.

BRIEF DESCRIPTION OF THE SEVERAL VIEWS OF THE DRAWINGS

An exemplary embodiment of the invention is illustrated in the drawings and further explained hereinunder. In the drawings.

The figures include in part simplified schematic illustrations. In part, identical reference numerals are used for identical but where appropriate non-identical elements. Various views of identical elements may have been scaled differently.

DETAILED DESCRIPTION

Figure 1:
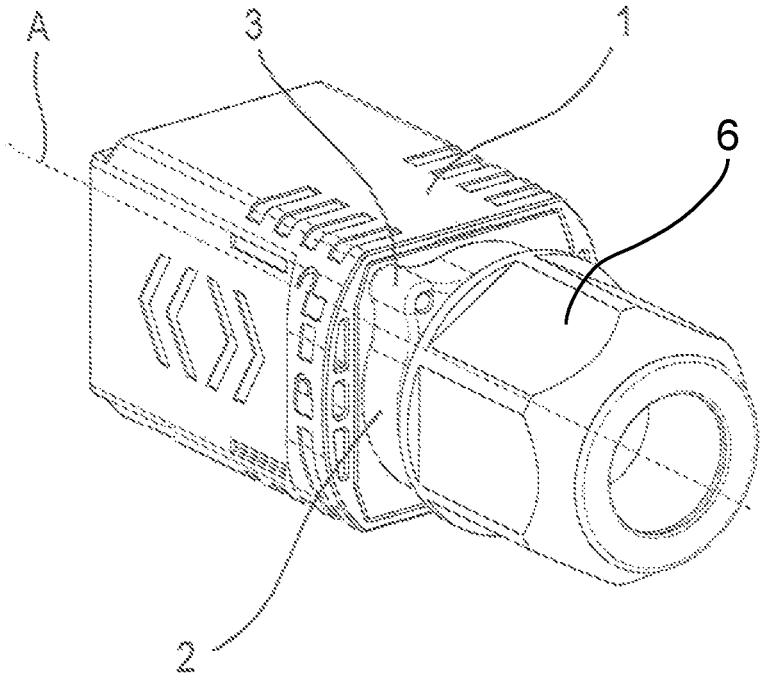
FIG. 1 illustrates a perspective view of a plug connector in accordance with the exemplary embodiment of the invention having a securing element in the opened position.

FIG. 1 illustrates a perspective view of a plug connector in accordance with an exemplary embodiment of the invention having a securing element 2 in an opened position. The plug connector includes a base body that extends along a plugging axis A. The plug has a plugging side in the rear left-hand region of FIG. 1. The plug connector has a connecting side in the opposite-lying, front right-hand region. The connecting side is formed by a cable gland according to the exemplary embodiment.

The base body of the plug connector is surrounded by a sliding element 1. The sliding element 1 may be displaced along the plugging axis A around a specific region. A latch that is located in the plug connector is opened and the connection to the mating plug connector may be released by displacing the sliding element 1 in the direction of the connecting side.

In accordance with the exemplary embodiment of the invention, the securing element 2 is arranged between the sliding element 1 and a cable gland 6 on the connecting side of the plug connector. The securing element 2 that is configured in an annular manner surrounds the connecting region of the plug connector and is attached in a rotatable manner to said plug connector. The securing element 2 comprises two blocking regions 3 (only one is visible in the figure). The blocking regions 3 are molded lying opposite one another on the securing element 2. In the illustrated opened position of the securing element 2 shown in FIG. 1, the blocking regions 3 lie in the corner regions of the sliding element 1. It is thus possible for the sliding element 1 to slide away over the blocking regions 3 in the direction of the connecting side of the plug connector.

Figure 2:
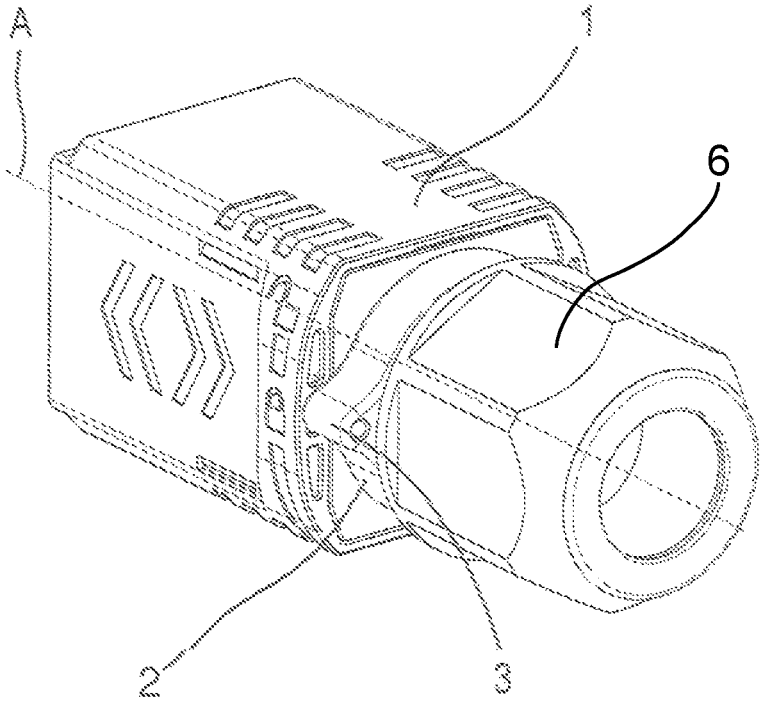
FIG. 2 illustrates a perspective view of the plug connector in accordance with the exemplary embodiment of the invention having the securing element in the locked position.

FIG. 2 illustrates a perspective view of the plug connector in accordance with the exemplary embodiment of the invention with the securing element 2 in a locked position. The securing element 2 is rotated on the plug connector by approximately 45° with respect to the opened position. The blocking regions 3 are located in front of the sliding element 1 by rotating the securing element 2 in such a manner that said blocking regions 3 may no longer be displaced in the direction of the connecting side. The plug connector may not be released form the mating connector and unlocked.

Figure 3:
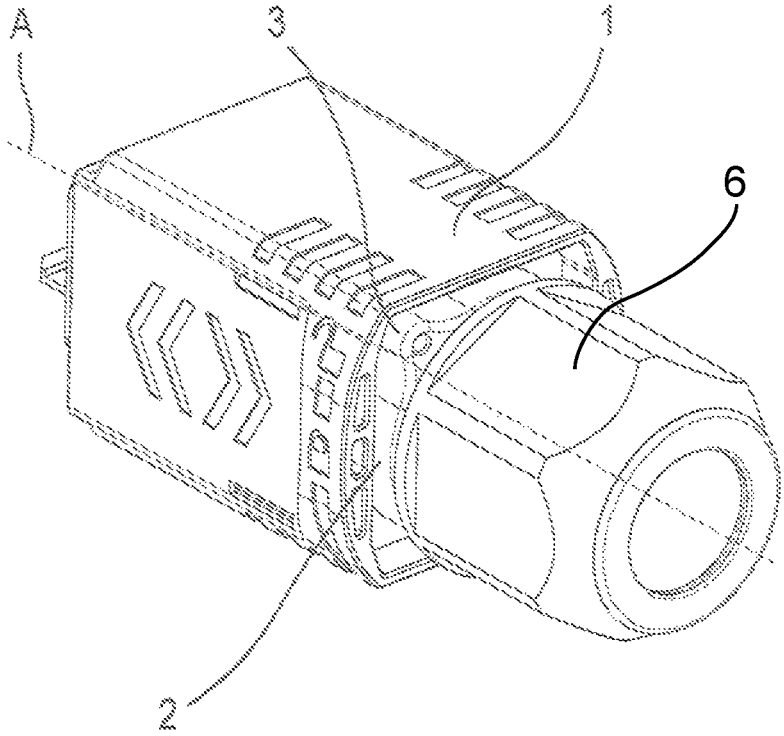
FIG. 3 illustrates a perspective view of the plug connector in accordance with the exemplary embodiment of the invention having an actuated sliding element.

FIG. 3 illustrates a perspective view of the plug connector in accordance with the exemplary embodiment of the invention with the sliding element 1 actuated toward the connecting side. The securing element 2 is located in the opened position, corresponding to FIG. 1. The sliding element 1 is simultaneously slid in the direction of the connecting side of the plug connector. The inner-lying latching devices or means of the plug connector are thus released. The blocking regions 3 are apparent (only one is visible) and said blocking regions 3 are accommodated in corner regions of the sliding element 1 and thus enable the sliding element 1 to move.

Figure 4:
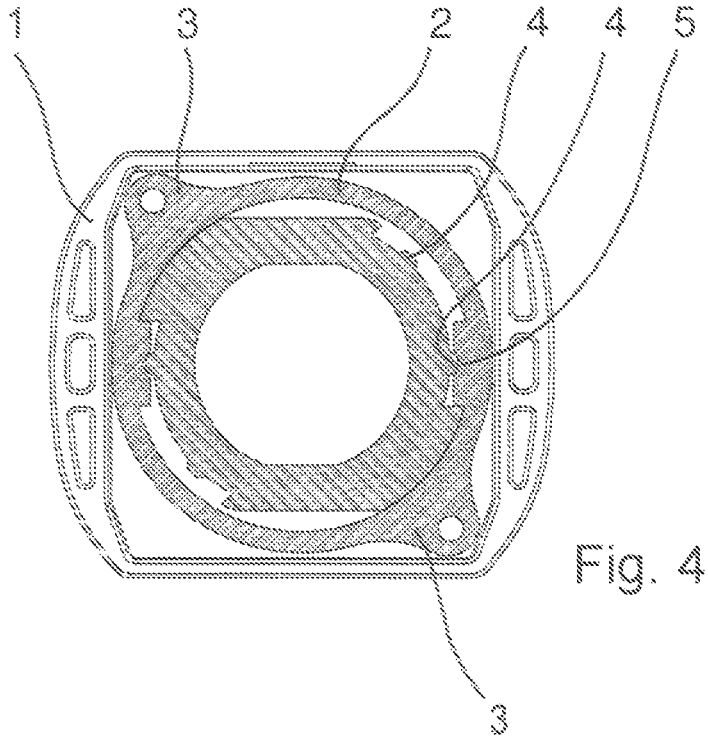
FIG. 4 illustrates a sectional view of the plug connector in accordance with the exemplary embodiment of the invention through an opened securing element.

The opened and locked positions of the securing element 2 are illustrated in FIG. 4 or FIG. 5 again, respectively, in a sectional view. The sectional view is respectively through the securing element 2 in a transverse manner with respect to the plugging axis A.

Figure 5:
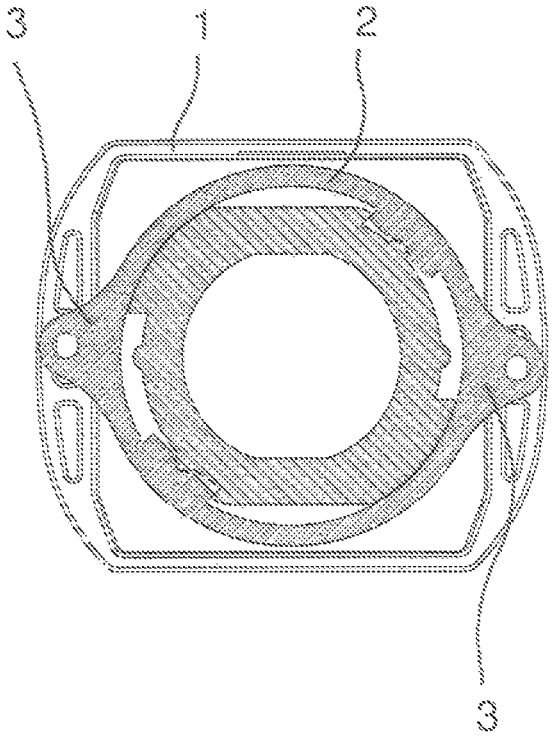
FIG. 5 illustrates a sectional view of the plug connector in accordance with the exemplary embodiment of the invention through a locked securing element.

It is easily apparent in FIG. 4 how the blocking regions 3 insert into the corner regions of the sliding element 1. In FIG. 5, the securing element 2 is rotated about approximately 45° with the result that the blocking regions 3 are rotated in front of the sides of the sliding element 1. A movement of the sliding element 1 is thus blocked and the plug connector is prevented from being released from the mating connector.

Moreover, a detent of the securing element 2 is apparent on the base body in FIG. 4 and FIG. 5. For this purpose, the base body comprises nubs 4 that define the respective opened or locked position. The securing element 3 may latch with corresponding grooves 5 on the nubs 4 of the base body in order to alternatively latch into the two positions. The securing element 2 may thus latch in the opened and the locked positions. The sliding element 1 is thus prevented from being accidentally released or blocked.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A plug connector that comprises a base body and a sliding element, wherein the base body comprises a plugging side and a connecting side, the plugging side being configured to interface with a mating plug connector, and the connecting side being configured to receive an electrical cable;

the plug connector forms a plugging axis that extends from the plugging side to the connecting side through the plug connector;

the sliding element is arranged on said base body in such a manner that said sliding element is able to move along the plugging axis;

the plug connector comprises a securing element, wherein the securing element is arranged between the sliding element and the connecting side of the plug connector;

the securing element is arranged to move on the base body between an open position, in which the sliding element is able to move along the plugging axis in a direction toward the connecting side, and a locked position, in which the sliding element is blocked by the securing element from moving along the plugging axis in the direction toward the connecting side; and the securing element is configured to lie within an inner peripheral edge of the sliding element when the securing element is in the open position such that the sliding element is able to move past the securing element when moving in the direction toward the connecting side.

2. The plug connector as claimed in claim 1, wherein the securing element is arranged between the sliding element and a cable gland of the plug connector.

3. The plug connector as claimed in claim 1, wherein the securing element is arranged in a rotatable manner on the plug connector.

4. The plug connector as claimed in claim 3, wherein the securing element is arranged on the plug connector in such a manner that said securing element may rotate about the plugging axis.

5. The plug connector as claimed in claim 1, wherein the securing element is configured in an annular manner and surrounds the base body.

6. The plug connector as claimed in claim 5, wherein the securing element comprises at least one blocking region wherein the blocking region extends radially from the plugging axis away from the securing element.

7. The plug connector as claimed in claim 6, wherein the at least one blocking region in the open position releases the sliding element to enable the sliding element to move; and the at least one blocking region in the locked position blocks the movement of the sliding element.

8. The plug connector as claimed in claim 6, wherein the securing element comprises two blocking regions.

9. The plug connector as claimed in claim 8, wherein the blocking regions are arranged on two opposite-lying circle segments of the securing element.

10. The plug connector as claimed in claim 8, wherein the securing element comprises four blocking regions that are arranged uniformly over a periphery of the securing element.

* * * * *